US005792731A

United States Patent [19]

Ichihashi et al.

[11] Patent Number: 5,792,731

[45] Date of Patent: Aug. 11, 1998

[54] LUBRICANT COMPOSITION FOR CONTINUOUS VARIABLE TRANSMISSIONS AND METHOD FOR LUBRICATING THEM WITH SAID LUBRICANT COMPOSITION

[75] Inventors: Toshihiko Ichihashi; Hideo Igarashi; Noboru Sonoda, all of Ichihara, Japan

[73] Assignee: Idemitsu Kosan Co., Ltd., Tokyo, Japan

[21] Appl. No.: 849,136

[22] PCT Filed: Oct. 3, 1996

[86] PCT No.: PCT/JP96/02877

§ 371 Date: Jun. 5, 1997

§ 102(e) Date: Jun. 5, 1997

[87] PCT Pub. No.: WO97/12950

PCT Pub. Date: Apr. 10, 1997

[30] Foreign Application Priority Data

Oct. 5, 1995 [JP] Japan ..... 7-258545

[51] Int. Cl.[6] ..... C10M 141/08; C10M 141/10

[52] U.S. Cl. ..... 508/322; 508/408; 508/441; 508/442; 508/586

[58] Field of Search ..... 508/322, 586, 508/441, 442, 408

[56] References Cited

U.S. PATENT DOCUMENTS 3,652,410 3/1972 Hollinghurst et al. ..... 508/442

5,492,638 2/1996 Wallace et al. ..... 508/460

*Primary Examiner*—Jacqueline V. Howard

*Attorney, Agent, or Firm*—Oblon, Spivak, McClelland, Maier & Neustadt, P.C.

[57] ABSTRACT

A lubricant composition for continuous variable transmissions which comprises a base oil and auxiliaries incorporated therein which are a sulfur-based extreme pressure additive (A), a phosphorus-based extreme pressure additive (B), and an alkaline earth metal-based detergent (C) It is superior in wear resistance and extreme pressure properties and keeps the coefficient of friction high for a long period of time, so that it is capable of transmitting a large capacity of torque when it is applied to an continuous variable transmission. It is particularly suitable for a transmission of metal belt type.

13 Claims, No Drawings

LUBRICANT COMPOSITION FOR CONTINUOUS VARIABLE TRANSMISSIONS AND METHOD FOR LUBRICATING THEM WITH SAID LUBRICANT COMPOSITION

TECHNICAL FIELD

The present invention relates to a lubricant composition for continuous variable transmissions and also to a method for lubricating continuous variable transmissions with said lubricant composition. This lubricant composition is superior in wear resistance and extreme pressure properties and is capable of keeping the coefficient of friction high for a long period of time and of transmitting a large amount of torque. It is particularly suitable for transmissions of metal belt type.

BACKGROUND ART

The conventional automotive automatic transmission consists of a torque converter and a finitely variable transmission comprising several gear trains. The transmission of this type has a problem with low efficiency due to slip loss in the torque converter and torque loss at the time of speed change. To address this problem, there has recently been developed an automotive continuous variable transmission that employs a steel belt. It is now in practical use.

This transmission, however, suffers the disadvantage that the coefficient of friction decreases so much under a high load that it cannot transmit a large torque and the belt slips at the time of rapid acceleration, resulting in a low ratio of torque transmission. This disadvantage arises from the fact that it is lubricated with the conventional lubricant (so-called ATF) for finitely variable transmissions. For this reason, the above-mentioned continuous variable transmission is used only for automobiles with a small-capacity engine (generating a small torque).

With a view to overcoming this disadvantage, attempts have been made to improve the ratio of torque transmission from the standpoint of mechanism. However, it has been found that improvement in torque transmission is incompatible with improvement in wear resistance, because torque transmission is always accompanied by slight slipping (which is inherent in the mechanism employed).

It is an object of the present invention to provide a lubricant composition and a method for lubrication with said lubricant composition. The lubricant composition of the present invention is superior in wear resistance and extreme pressure properties, capable of keeping a coefficient of friction high for a long period of time, and capable of transmitting a large amount of torque. It is particularly suitable for transmissions of metal belt type.

DISCLOSURE OF THE INVENTION

The present inventors carried out a series of researches to develop a lubricant composition for continuous variable transmissions which meets the above-mentioned requirements. As a result, it was found that a lubricant keeps the coefficient of friction higher than 0.10 for a long period time if its base oil is incorporated with a sulfur-based extreme pressure additive, a phosphorus-based extreme pressure additive, and an alkaline earth metal-based detergent as essential ingredients. This finding led to the present invention.

It is an object of the present invention to provide a lubricant composition for continuous variable transmissions which comprises a base oil, a sulfur-based extreme pressure additive (A), a phosphorus-based extreme pressure additive (B), and an alkaline earth metal-based detergent (C).

It is another object of the present invention to provide a method for lubricating continuous variable transmissions with said lubricant composition.

The preferred embodiments of the present invention are as follows.

A lubricant composition for continuous variable transmissions as defined above, wherein the sulfur-based extreme pressure additive is at least one species selected from sulfurized oils and fats, thiocarbamates, and thioterpenes.

A lubricant composition for continuous variable transmissions as defined above, wherein the phosphorus-based extreme pressure additive is at least one species selected from tricresyl phosphate and amine salts of alkyl or alkenyl acid phosphate ester.

A lubricant composition for continuous variable transmissions as defined above, wherein the alkaline earth metal-based detergent is calcium phenate.

A lubricant composition for continuous variable transmissions as defined above, wherein the amount of components (A), (B), and (C) based on the total amount of the lubricant composition is 0.05–5 wt %, 0.05–5 wt %, and 0.05–8 wt %, respectively.

A lubricant composition for continuous variable transmissions as defined above, wherein the continuous variable transmission is of metal belt type.

A method for lubricating continuous variable transmissions with the lubricant composition defined above.

A method for lubricating continuous variable transmissions, designed for performing continuous speed change and torque transmission simultaneously, with the lubricant composition defined above.

BEST MODE OF CARRYING OUT THE INVENTION

The lubricant composition of the present invention is prepared usually from a mineral oil or synthetic oil as the base oil which is not specifically restricted in kind and properties. Preferred base oils are those which have a kinematic viscosity (at 100° C.) of 1–50 cSt, preferably 2–15 cSt, a value of % $C_A$ (ASTM D3238-80) smaller than 20, preferably smaller than 10, and a pour point of lower than −10° C., preferably lower than −15° C.

Examples of the mineral oil include paraffin oil, intermediate oil, and naphthene oil, which are obtained by the ordinary refining process such as solvent extraction and hydrogenation. Of these examples, paraffin oil is particularly preferable.

Examples of the synthetic oil include polybutene, polyolefins (such as α-olefin homopolymer and copolymer like ethylene-α-olefin copolymer), esters (such as polyol ester, dibasic acid ester, and phosphoric ester), ethers (such as polyphenyl ether), polyglycol, alkylbenzne, and alkylnaphthalene. Of these examples, polyolefins and polyol esters are preferable.

The above-mentioned mineral oils and synthetic oils may be used alone or in combination with one another as the base oil.

The lubricant composition of the present invention contains a sulfur-based extreme pressure additive as the component (A), which is not specifically restricted so long as it has sulfur in the molecule and is capable of dissolving or uniformly dispersing in the base oil to exhibit the extreme pressure properties and good wear resistance. It includes, for example, sulfurized vegetable and animal oils and synthetic oils, olefin polysulfide, dihydrocarbyl polysulfide, sulfurized mineral oils, thiocarbamates, thioterpenes, and dialkyl thiodipropionates.

Examples of the sulfurized vegetable and animal oils include sulfurized lard, sulfurized rapeseed oil, sulfurized castor oil, sulfurized soybean oil, sulfurized rice bran oil, disulfurized fatty acids (such as sulfurized oleic acid), and sulfurized esters (such as sulfurized methyl oleate). Olefin polysulfides are obtained by reacting $C_{3-20}$ olefins or its oligomer with a sulfurizing agent. The preferable examples of the olefin include propylene, isobutene, and diisobutene. The examples of the sulfurizing agent include sulfur and sulfur halide such as sulfur chloride.

The dihydrocarbyl polysulfide is a compound represented by the formula (I) below.

$$R^1\text{-}S_x\text{-}R^2 \quad (I)$$

(where $R^1$ and $R^2$ each denotes a $C_{1-20}$ alkyl group, a $C_{6-20}$ aryl group, a $C_{7-20}$ alkylaryl group, or a $C_{7-20}$ arylalkyl group (which may be the same or different), and x is a real number (or a rational number) of 2–8.)

Examples of the groups represented by $R^1$ and $R^2$ in the formula (I) above include methyl group, ethyl group, n-propyl group, isopropyl group, n-butyl group, isobutyl group, sec-butyl group, t-butyl group, pentyl groups, hexyl groups, heptyl groups, octyl groups, nonyl groups, decyl groups, dodecyl groups, cyclohexyl group, cyclooctyl group, phenyl group, naphthyl group, tolyl group, xylyl group, benzyl group, and phenethyl group.

Preferred examples of the dihydrocarbyl polysulfide include dibenzyl polysulfide, di-t-nonylpolysulfide, and didodecyl polysulfide.

Examples of the thiocarbamates include zinc dithiocarbamate. Examples of the thiopertene include a reaction product of pinene and phosphorus pentasulfide. Examples of the dialkyl thiodipropionate include dilauryl thiodipropionate and distearyl thiodipropionate. Of these inert extreme pressure additive such as sulfurized oils, thiocarbamates, and thioterpenes are preferable in terms of extreme pressure properties and wear resistance.

In the present invention, the above-mentioned sulfur-based extreme pressure additives may be used alone or in combination with one anther. Their amount should be 0.05–5 wt % of the total amount of the lubricant composition. An amount less than 0.05 wt % is not enough for sufficient extreme pressure performance and wear resistance. An amount exceeding 5 wt % produces an adverse effect on the oxidative stability. A preferred amount (from the standpoint of extreme properties, wear resistance, and oxidative stability) is 0.1–3 wt % of the total amount of the lubricant composition.

The lubricant composition of the present invention contains a phosphorus-based extreme pressure additive as the component (B), which is not specifically restricted so long as it has phosphorus in the molecule and is capable of dissolving or uniformly dispersing in the base oil to exhibit the extreme pressure properties and good wear resistance. It includes, for example, phosphate ester, acid phosphate ester, phosphite ester, acid phosphite ester, thiophosphate ester, acid thiophosphate ester, amine salts thereof, and phosphosulfurized terpenes (such as reaction products of pinene and phosphorus pentasulfide).

Examples of the phosphate ester and phosphite ester include tributyl phosphate and phosphite, trihexyl phosphate and phosphite, tri-2-ethylhexyl phosphate and phosphite, tridecyl phosphate and phosphite, trilauryl phosphate and phosphite, trimyristyl phosphate and phosphite, tripalmityl phosphate and phosphite, tristearyl phosphate and phosphite, trioleyl phosphate and phosphite, and other $C_{3-30}$ alkyl or alkenyl phosphate or phosphite esters; and triphenyl phosphate and phosphite, tricresyl phosphate and phosphite, and other $C_{6-30}$ aryl phosphate or phosphite esters.

Examples of the acid phosphate or phosphite ester include mono- or dibutyl hydrogen phosphate and phosphite, mono- or dipentyl hydrogen phosphate and phosphite, mono- or di-2-ethylhexyl hydrogen phosphate and phosphite, mono- or dipalmityl hydrogen phosphate and phosphite, mono- or dilauryl hydrogen phosphate and phosphite, mono- or distearyl hydrogen phosphate and phosphite, mono- or dioleyl hydrogen phosphate and phosphite, and other $C_{3-30}$ alkyl or alkenyl acid phosphate and phosphite; and mono- or diphenyl hydrogen phosphate and phosphite, mono- or dicresyl hydrogen phosphate and phosphite, and other $C_{6-30}$ aryl acid phosphate and phosphite.

Examples of the thiophosphate ester and thiophosphite ester include those which correspond to the above-listed phosphate esters and acid phosphate esters.

The above-mentioned esters may form amine salts with a mono-, di- or trisubstituted amine represented by the formula (II) below.

$$R_nNH_{3-n} \quad (II)$$

(where R denotes a $C_{3-30}$ alkyl or alkenyl group, a $C_{6-30}$ aryl group or aralkyl group, or a $C_{2-30}$ hydroxyalkyl group; and n is 1, 2, or 3. Two or more R's may be the same or different. The alkyl or alkenyl group may be straight, branched, or cyclic.)

Examples of the monosubstituted amine include butylamine, pentylamine, hexylamine, cyclohexylamine, octylamine, laurylamine, stearylamine, oleylamine, and benzylamine. Examples of the disubstituted amine include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monoethanolamine. Examples of the trisubstituted amine include tributylamine, triphenylamine, triheyxlamine, tricyclohexylamine, trioctylamine, trilaurylamine, tristearylamine, trioelylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine.

Of these phosphorus-based extreme pressure additives, tricresyl phosphate and amine salts of alkyl or alkenyl acid phosphate ester are preferable because of their good extreme pressure properties and wear resistance.

Some of the above-listed phosphorus-based extreme pressure additives will serve as the components (A) and (B) because they contain both sulfur and phosphorus in the molecule. They include thiophosphate ester, acid thiophosphate ester and amine salts thereof, and sulfurized terpenes.

The above-mentioned phosphorus-based extreme pressure additives may be used alone or in combination with one another. Their amount should be 0.05–5 wt %, preferably 0.1–3 wt %, of the total amount of the lubricant composition.

An amount less than 0.05 wt % is not enough for satisfactory extreme pressure properties and wear resistance. An amount exceeding 5 wt % leads to sludge and rust.

The lubricant composition of the present invention contains an alkaline earth metal-based detergent as the component (C), which is not specifically restricted so long as it has alkaline earth metal in the molecule and is capable of dissolving or uniformly dispersing in the base oil to exhibit the extreme pressure properties and good wear resistance. It includes, for example, sulfonate, phenate, salicylate, and phosphate of alkaline earth metal. Calcium phenate is desirable because of its ability to improve the coefficient of friction.

The alkaline earth metal-based detergent should preferably have a base number in the range of 80–350 mg KOH/g. With a base number lower than specified, it does not produce the desired effect. With a base number higher than specified, it has an adverse effect on wear resistance. A preferred base number ranges from 100 to 280 mg KOH/g.

The alkaline earth metal-based detergents may be used alone or in combination with one another. Their amount should be 0.05–8 wt %, preferably 0.1–4 wt %, of the total amount of the lubricant composition. An amount less than 0.05 wt % is not enough for satisfactory effect. An amount exceeding 8 wt % leads to incomplete dissolution in the base oil.

The lubricant composition of the present invention may be incorporated with the following optional additives in an amount not harmful to the object of the present invention. Antioxidant, ashless dispersant, viscosity index improver, pour point depressant, rust preventive, metal deactivator, anti-foaming agent, surface active agent, and coloring agent.

The antioxidant fall into three categories as follows.

(1) Hindered phenol.

4,4'-bis(2,6-di-t-butylphenol), 4,4-bis(2-methyl-6-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidnebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-diemthylphenol), 2,2'-methylenebis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-amyl-p-crsol, 2,6-di-t-butyl-4-(N,N'-dimethylaminophenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl)sulfide, bis(3,5-di-t-butyl-4-hydroxybenzyl)sulfide, n-octadecyl-3-(4-hydroxy-3,5-di-t-butylphenyl) propionate, and 2,2'-thio[diethyl-bis-3-(3,5-di-t-butyl-4-hydroxyphenyl) propionate].

Those of bisphenol type and ester group-containing phenol type are preferable.

(2) Amine.

Monoalkyldiphenylamine such as monooctyldiphenylamine and monononyl-diphenylamine. Dialkyldiphenylamine such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine. Polyalkyldiphenylamine such as tetrabutyldiphenylamine, tetrahexyldiphenylamine, tetraoctyldiphenylamine, and tetranonyldiphenylamine. Naphthylamine such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine, and other alkyl-substituted-phenyl-α-naphthylamines.

Of these examples, dialkyldiphenylamine and naphthylamine are preferable.

(3) Zinc dialkyldithiophosphate (ZnDTP). Zinc diamyldithiophosphate, zinc dibutyldithiophosphate, and zinc di-(2-ethylhexyl)dithiophosphate.

Examples of the ashless dispersant include succinimide, polybutenyl succinimide, boron-containing succinimide, benzylamine, boron-containing benzylamine, succinate ester, and amide of fatty acid or mono- or dibasic carboxylic acid represented by succinic acid.

Examples of the viscosity index improver include polymethacrylate, dispersed polymethacrylate, olefin copolymer (such as ethylene-propylene copolymer), dispersed olefin copolymer, and styrene copolymer (such as styrene-diene (hydrogenated) copolymer. Examples of the pour point depressant include polymethacrylate.

The rust preventive includes, for example, alkenyl succinic acid and partial ester thereof. The metal deactivator includes, for example, benzotriazole, benzimidazole, benzothiazole, and thiaziazole. The anti-foaming agent includes, for example, dimethylpolysiloxane and polyacrylate. The surface active agent includes, for example, polyoxyethylene alkylphenyl ether. These additives are usually incorporated in an amount of 0.01–10 wt % of the total amount of the composition.

The lubricant composition of the present invention is capable of keeping the coefficient of friction higher than 0.10 for a long period of time; therefore, it is capable of torque transmission in large capacities and it is particularly suitable for transmission of metal belt type.

To further illustrate the invention, and not by way of limitation, the following examples are given.

EXAMPLES 1 TO 3 AND COMPARATIVE EXAMPLES 1 TO 4

In each example, a lubricant composition was prepared from a paraffin mineral oil (as the base oil) and additives (shown in Table 1) by stirring at 60° C.

The resulting lubricant composition was measured for the coefficient of friction and the length of the time through which the coefficient of friction was maintained by using a pin-on-disc tester in the following manner. The results are shown in Table 1. Conditions for the pin-on-disc tester:

Amount of oil: 600 ml

Temperature of oil: 130° C.

Slip speed: 1200 mm/sec

Surface pressure: 20 kgf/cm$^2$

Pin: S45C

Disc: SCM420

Duration: 240 minutes

The coefficient of friction was measured after 240 minutes. The length of the time (in minutes) through which the coefficient of friction higher than 0.10 was maintained was measured.

TABLE 1

| | | Example | | | Comparative Example | | | |
|---|---|---|---|---|---|---|---|---|
| | | 1 | 2 | 3 | 1 | 2 | 3 | 4 |
| Lubricant composition (wt %) | | | | | | | | |
| Paraffin base oil | | 92.0 | 91.5 | 90.5 | 92.0 | 92.0 | 92.0 | 92.5 |
| (A) | Sulfurized oil | 0.5 | — | 1.0 | 1.0 | 1.0 | — | 1.0 |
| | Thioterpene | — | 1.0 | — | — | — | — | — |
| (B) | Tricresyl phosphate | 0.5 | — | — | 1.0 | — | 1.0 | — |
| | Acid phosphate ester amine | — | 0.5 | 1.0 | — | — | — | — |
| (C) | Calcium sulfonate | — | — | 1.0 | — | — | 1.0 | — |
| | Calcium phenate | 1.0 | 1.0 | — | — | 1.0 | — | — |
| Others | ZnDTP | — | — | 0.5 | — | — | — | 0.5 |
| | Succinimide dispersant | 1.0 | 1.0 | 1.0 | 1.0 | 1.0 | 1.0 | 1.0 |
| | Polymethacrylate | 5.0 | 5.0 | 5.0 | 5.0 | 5.0 | 5.0 | 5.0 |
| Coefficient of friction | | 0.14 | 0.14 | 0.12 | 0.09 | 0.06 | 0.09 | 0.07 |
| Duration of coefficient of friction (min) | | 240< | 240< | 240< | 20 | 15 | 60 | 60 |

Note Table 1
Base oil: kinematic viscosity, 4.5 cSt (100° C.); % $C_A$, 0.1; pout point, 17.5° C.
Sulfurized oil: sulfurized lard (9 wt % sulfur)
Thioterpene: reaction product of phosphorus pentasulfide and pinene (10 wt % sulfur)
Acid phosphate ester amine: amine salt of dilauryl acid phosphate
Calcium sulfonate: Base number 280 mg KOH/g
Calcium phenate: base number 250 mg KOH/g
ZnDTP: zinc di-$C_{4-6}$-alkyldithiophosphate
Succinimide dispersant: polybutenylsuccinimide
Polymethacrylate: molecular weight 40,000

It is noted from Table 1 that the samples in Comparative Examples decrease in the coefficient of friction (and hence become poor in torque transmission) more rapidly than the samples in Examples.

COMPARATIVE EXAMPLE 5

The pin-on-disc test as mentioned above was conducted on a commercial automatic transmission fluid (ATF) equivalent to Dexiron III®. Seizure took place one minute after the start of the test.

The above-mentioned results suggest that the lubricant composition of the present invention maintains the coefficient of friction higher than 0.10 for a long period of time, so that it is capable of transmitting a large capacity of torque when it is applied to an continuous variable transmission. It is suitable for a transmission of metal belt type.

Industrial Applicability

The lubricant composition of the present invention is superior in wear resistance and extreme pressure properties and keeps the coefficient of friction high for a long period of time, so that it is capable of transmitting a large capacity of torque when it is applied to an continuous variable transmission. It is particularly suitable for a transmission of metal belt type.

We claim:

1. A method for lubricating a continuous variable transmission with a lubricant composition, which comprises applying said lubricant composition to said continuous variable transmission, wherein said lubricant composition comprises a base oil, a sulfur-based extreme pressure additive (A), a phosphorus-based extreme pressure additive (B), and an alkaline earth metal-based detergent (C), and wherein said sulfur-based extreme pressure additive (A) is selected from the group consisting of sulfurized oils and fats, zinc dithiocarbamates and thioterpenes.

2. The method of claim 1, wherein said continuous variable transmission is designed for performing continuous speed change and torque transmission simultaneously.

3. The method of claim 1, wherein said continuous variable transmission contains a metal belt.

4. The method of claim 1, wherein the phosphorus-based extreme pressure additive is selected from the group consisting of tricresyl phosphate, amine salts of alkyl acid phosphate esters and amine salts of alkenyl acid phosphate esters.

5. The method of claim 1, wherein the alkaline earth metal-based detergent is calcium phenate.

6. The method of claim 1, wherein in said lubricant composition, the amount of components (A), (B), and (C) based on the amount of the lubricant composition is about 0.05–5 wt. %, 0.05–5 wt. %, and 0.05–8 wt. %, respectively.

7. The method of claim 1, wherein said base oil has a kinematic viscosity at 100° C. of from 1 to 50 cSt, a value of % $C_A$ (ASTM D3238-80) less than 20, and a pour point of lower than −10° C.

8. The method of claim 7, wherein said base oil has a kinematic viscosity at 100° C. of from 2 to 15 cSt, a value of % $C_A$ (ASTM D3238-80) less than 10, and a pour point of lower than −15° C.

9. The method of claim 7, wherein said base oil is a mineral oil selected from the group consisting of paraffin oil, intermediate oil and naphthene oil.

10. The method of claim 7 wherein said base oil is a synthetic oil selected from the group consisting of polybutene, polybutene, polyolefins, esters, ethers, polyglycol, alkylbenzene and alkylnaphthalenes.

11. The method of claim 1, wherein said sulfurized oils are selected form the group consisting of sulfurized lard, sulfurized rapeseed oil, sulfurized castor oil, sulfurized soybean oil and sulfurized rice bran oil.

12. The method of claim 1, wherein said sulfurized fat is sulfurized oleic acid.

13. The method of claim 1, wherein said thioterpene is a reaction product of pinene and phosphorus pentasulfide.

* * * * *